United States Patent [19]

Salzer

[11] Patent Number: 5,060,582

[45] Date of Patent: Oct. 29, 1991

[54] HIGH SECURITY BLAST RESISTANT DOOR LEAF

[75] Inventor: Heinrich Salzer, Marburg, Fed. Rep. of Germany

[73] Assignee: Salzer Sicherheitstechnik GmbH, Wehrda, Fed. Rep. of Germany

[21] Appl. No.: 597,433

[22] Filed: Oct. 15, 1990

[30] Foreign Application Priority Data

Oct. 20, 1989 [DE] Fed. Rep. of Germany ..... 3934983

[51] Int. Cl.[5] ..... E06B 9/00

[52] U.S. Cl. ..... 109/49.5; 109/74; 109/65; 109/80; 109/82; 70/DIG. 49

[58] Field of Search ..... 70/417, 418, DIG. 49; 109/38, 49.5, 64, 65, 74, 75, 77, 80, 82, 84; 292/DIG. 59

[56] References Cited

U.S. PATENT DOCUMENTS

| | | | |
|---|---|---|---|
| 1,035,164 | 8/1912 | Custer | 109/74 |
| 1,118,435 | 11/1914 | Mosler et al. | 109/75 |
| 1,623,155 | 4/1927 | Bellamore | 109/65 |
| 2,492,422 | 12/1949 | Govan | 109/80 |
| 2,552,515 | 5/1951 | Bremer | 109/77 |
| 3,179,553 | 4/1965 | Franklin | 109/49.5 X |
| 3,810,145 | 5/1974 | Gusaras | 70/DIG. 49 X |
| 4,523,528 | 6/1985 | Hastings et al. | 109/82 X |
| 4,567,100 | 1/1986 | Pickett et al. | 109/82 X |
| 4,727,789 | 3/1988 | Katsanis et al. | 109/49.5 X |
| 4,822,657 | 4/1989 | Simpson | 109/80 |

FOREIGN PATENT DOCUMENTS

| | | | |
|---|---|---|---|
| 2839588 | 3/1980 | Fed. Rep. of Germany . | |
| 2927296 | 1/1981 | Fed. Rep. of Germany | 109/65 |

*Primary Examiner*—Rodney M. Lindsey
*Assistant Examiner*—Suzanne L. Dino
*Attorney, Agent, or Firm*—Mark T. Basseches

[57] ABSTRACT

A bullet and blast resistance door leaf is comprised of inner and outer sheets connected by a profile section forming an end face of said leaf. The profile section includes an outer step and an inner step, the outer step extending laterally outwardly beyond the inner step. Outer and inner plates are connected to the outer and inner steps respectively, dividing the interior of the leaf into inner, outer and central chambers. A lock mechanism is mounted in the central chamber and projects through the profile, the lock mechanism being shielded by the outer plate. The inner and outer chambers may include insulation, and the outer chamber may include a sensor for activating an alarm.

5 Claims, 1 Drawing Sheet

HIGH SECURITY BLAST RESISTANT DOOR LEAF

BACKGROUND OF THE INVENTION

This invention relates to a blast and bullet resistant door leaf construction.

PRIOR ART

Generally known door leaves often have interior parts contributing to security, for example more resistant to penetration by bullets, burning through, blasting open, or other attempts to force the door leaf.

Bullet proofing in particular has hitherto involved at least one interior steel plate extending under an outer sheet of the door leaf. Maximizing resistance to bullet penetration has involved interior steel plate of very substantial thickness or an appropriate pack or set of steel-plates. A disadvantage has been the requirement for incorporated steel plates to be recessed in order to accommodate lock means thus producing a weak point with respect to the bullet proofing. Clearly, such weak points arise wherever, say for improved other break-in resistance, additional locking or latching means are provided in the door leaf.

High thermal conductivity of steel plate(s) can act counter to desired fire-retardation effects. Indeed, heat exposure can result in ignition through the steel plate(s), i.e. there is then transmission of fire from the fire source through the door leaf even if it is kept in its closed and locked state.

Known fire-resistant doors have therefore tended to have a quite different door-leaf construction from bullet or blast resistant doors. Interiorly, structural members having a high thermal conductivity are dispensed with, and heat insulating-material, such as mat, has been maximized behind the outer sheet(s), preferably filling the whole of the interior of the door-leaf. It is also known to replace or supplement the insulating material by a substance which effervesces under the action of heat and which, upon the effervescing, releases water and thus brings about a cooling of the door-leaf parts. However, a door leaf designed in this way neither affords high security relative to bullets, blasting, or burning through and does not protect the locking mechanisms.

From German Offenlegungsschrift 28 39 588 a door leaf of the blast resistant type is known which has three chambers which are formed by cover sheets and safety plates. An outer chamber on one side is filled with rubber/ceramic plates, but to which, however, no significant insulating function is ascribed.

SUMMARY OF THE INVENTION

It is an object of this invention to provide a door leaf construction having particular high capability for resistance against break-through, break-in, blasting and fire, but which can be produced from only a few component parts.

According to this invention, there is provided a door leaf comprising a box formation having two outer sheets forming door leaf main faces and a profile having steps against which edge-adjacent parts of spaced inner plates bear and to which they are secure, a central chamber of the door leaf between the inner plates serving to house locking means for the door leaf, and each of two other outer chambers of the door leaf between the inner plates and the outer sheets being filled with other material, preferably insulation.

In one embodiment, from the profile formation is a separately made part subsequently secured to the outer sheets by bent-in edge-adjacent portions thereof overlapping onto the profile formation.

In a further embodiment, the profile formation is integral with one of the outer sheets by edge-adjacent bending thereof and is secured to overlapping bend edgeadjacent formations of the other outer sheet. Weld beads are preferred for connection/securement purposes.

Plural stepping of the profile formation not only gives particularly high stability, but is readily produced. Moreover, its steps present bearing surfaces and securement portions for the inner plates, particularly facilitating welding. A layered construction of the door leaf results, and the inner plates can be fastened successively at their edges.

Particularly good fire resistance can be achieved if filler(s) for outer chambers bounded by respective outer sheets and inner plates comprise an insulating material made of wood and/or ceramic and/or gypsum and/or mineral fibers.

For response to attempted shoot-through, intrusion or bursting, which merely damages an outer sheet of the door leaf, or also in case of fire, a development hereof additionally provides for the outer chamber most likely to be attacked to contain a damage-sensitive electrical conductor arrangement, say extending in close spacing of its parts over the height and width of the door leaf, and which is a constituent part of an alarm installation. If the outer sheet facing the vulnerable side is only partially damaged, the electrical conductor below that cover sheet responds. A complete alarm system remote from the door leaf can further respond acoustically and/or optically.

BRIEF DESCRIPTION OF THE DRAWINGS

Two exemplary embodiments of a door leaf of the invention are shown in a broken-away cross-section in the accompanying drawings, and are described in more detail hereinunder. In the drawings.

DETAILED DESCRIPTION OF THE DRAWINGS

Figure 1:
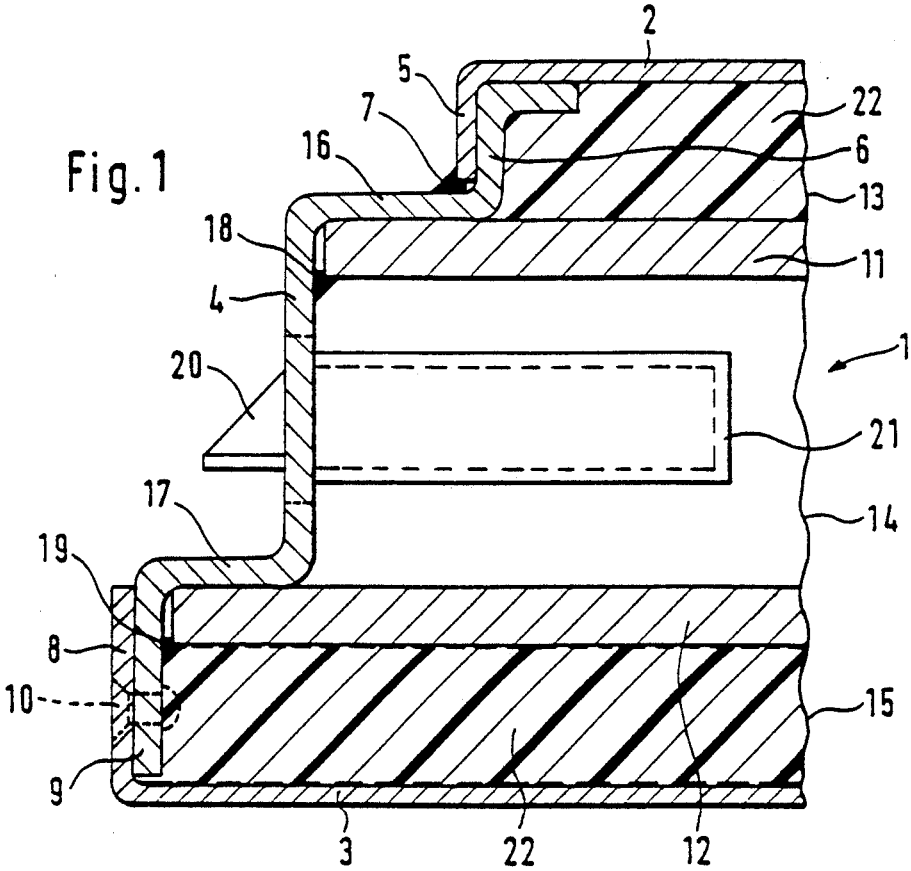
FIG. 1 is a horizontal fragmentary section through a door leaf.

The door leaf of FIG. 1 comprises a box formation 1 of which two spaced outer sheets 2 and 3 form the door leaf main faces and are connected by a multiple stepped profile part 4 at the door leaf edges.

An inwardly bent edge strip 5 of one outer sheet 2 overlaps an angle-formed edge strip 6 of the profile 4 and is connected thereto by a weld bead 7.

An inwardly bent edge strip 8 of the other outer sheet 3 overlaps another edge strip 9 of the profile 4 and is connected thereto, i.e. by blind rivets 10 at intervals along the lengths of the edge-strips 8 and 9.

Interiorly, the box 1 is subdivided into three chambers 13, 14 and 15 by two interior plates 11 and 12 disposed at parallel spacings from the outer sheets 2 and 3. The edge region of one interior plate 11 lies against a stepping 16 of the profile 4, and the edge region of the other interior plate 12 lies against stepping 17 of the profile 4. The interior plates 11 and 12 are connected to the profile 4 by means of weld beads 18 and 19, respectively.

The central chamber 14 between the interior plates 11 and 12 is shown having a lock 21 with a latch or bolt 20 protruding through the profile in between the steppings 16 and 17. There could be further locking means in the chamber 14. The two outer chambers 13 and 15 are shown filled by material 22 that can conveniently have insulating properties. The material 22 may be wood and/or ceramic and/or gypsum and/or mineral fiber etc., i.e. any convenient insulating material.

Figure 2:
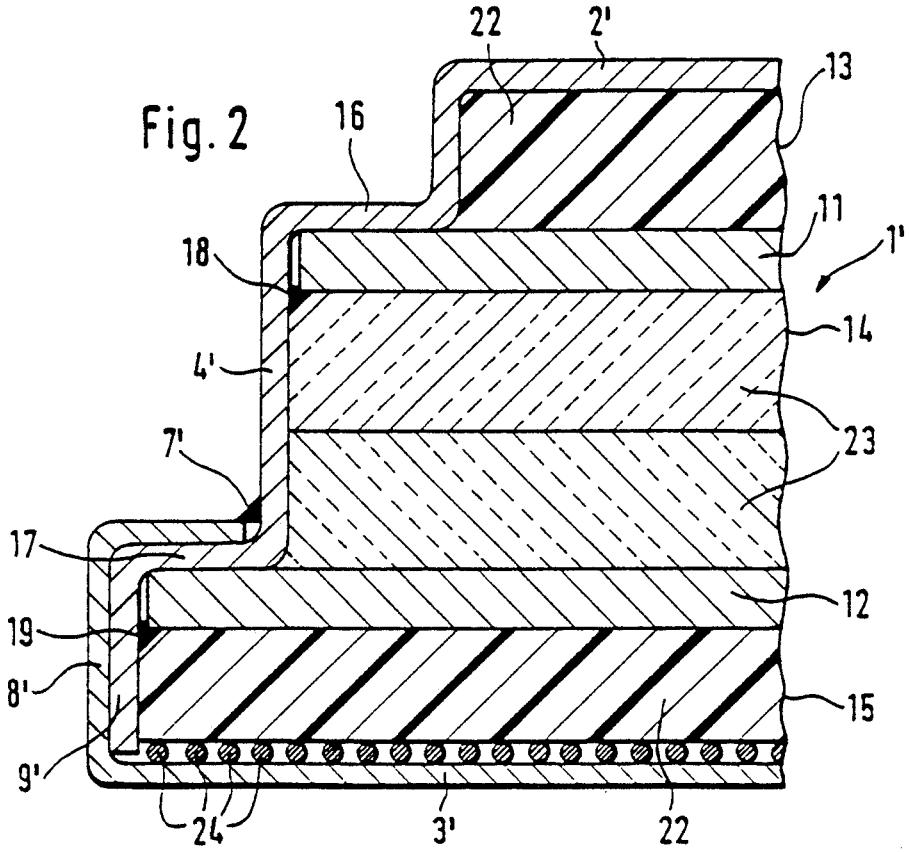
FIG. 2 is a horizontal fragmentary section through a door leaf in accordance with an embodiment of the invention.

The door leaf of FIG. 2 also comprises a box 1' having two outer sheets 2' and 3' forming door leaf main faces. Plural stepping of the edge of one cover sheet 2' provides an integral profile 4' extending much as the separate profile member 4 of FIG. 1 in affording door leaf edge faces.

A U- or return-shaped bent edge strip 8' of the cover sheet 3' goes over free edge strip 9' of the profile 4' and the adjacent step 17 and is secured by a weld bead 7'.

The interior of the box 1' is, as for the door of FIG. 1, subdivided into three chambers 13, 14 and 15 by two interior plates 11 and 12 arranged at parallel spacings from the cover sheets 2' and 3' with their edge regions lying against steps 16 and 17 of the profile 4' formed integral with cover sheet 2' and connected to profile 4' by weld beads 18,19 respectively. In this embodiment the outer sheets 2' and 3' need only the weld bead 7' to secure them together.

The central chamber 14 between the interior plates 11 and 12 can, as for FIG. 1, have locking means (not shown), and is additionally shown with two mineral fiber mats 23 therein. The two outer chambers 13 and 15 are again shown filled with insulating filler 22.

The chamber 15 of FIG. 2 is shown provided at the inside of the outer sheet 3' with electrical conductor means affording serial or parallel connected parts 24 extending over the outer sheet 3, in a height-wise direction and at close spacings width-wise. An electrical conducting loop arrangement is convenient. The conductor means 24 is conveniently in a circuit (not shown) of an alarm system that may rely on quiescent current conduction. If the conductor means 24 is interrupted or otherwise affected by damage to the door leaf 31, that state can be signalled by the alarm system, ultimately acoustically or optically, i.e. as a reaction to change of quiescent current conditions. It is, of course, equally feasible for an alarm system to react to changes in electrical resistance, including sensitivity to localized displacement of mutually non-insulated parts of the conductor 24. The side of the door leaf as so equipped will normally be that most likely to be subject to attack. It will be appreciated that it is advantageous for the plural stepped door edge formations to be at least at vertical sides of a conventionally fitted door lead, but could also be at the top and or the bottom.

As shown, substantial security or strength is afforded by the cover plates 11, 12, such security being possibly greater than that provided by the outer sheets 2, 3. However, overall structural integrity is high, particularly protection of locks and latches. Also, insulation from sound and/or heat penetration is excellent, as well as giving high resistance to bullet penetration and/or blasting and/or burning through.

I claim:

1. A bullet and blast resistant door leaf comprising inner and outer sheets defining the inner and outer faces of said door leaf, said outer sheet extending laterally beyond said inner sheet, a profile section forming an end face of said leaf and extending between said inner and outer sheets, said profile section including a first step portion interposed between said faces and extending inwardly generally in the plane of said leaf, and a second step portion interposed between said first step portion and said inner sheet and extending inwardly generally in the plane of said sheets, said first step portion extending laterally outwardly beyond said second step portion, an outer plate disposed in the plane of said leaf and secured to said profile section and having outer edge portions bearing against said first step portion, an inner plate disposed in the plane of said leaf and secured to said profile section and having outer edge portions bearing against said second step portion, said plates being of substantially greater thickness than said inner and outer sheets and dividing the interior of said leaf into inner, outer, and central chambers, and lock means mounted within said central chamber and extending laterally outwardly through said profile section, said outer plate extending laterally outwardly beyond the outermost lateral extremity of said lock means, whereby said lock means is shielded by said outer plate.

2. A door leaf in accordance with claim 1, and including insulating material disposed within said inner and outer chambers.

3. A door leaf in accordance with claim 2, wherein said profile section is formed integrally with one of said inner and outer sheets.

4. A door leaf in accordance with claim 2, wherein said inner and outer plates are secured to said profile by welding.

5. A door leaf in accordance with claim 2, and including sensor means disposed in said outer chamber for activating an alarm.

* * * * *